US008087817B2

(12) United States Patent
Jiang et al.

(10) Patent No.: US 8,087,817 B2
(45) Date of Patent: Jan. 3, 2012

(54) APPARATUS AND METHOD FOR AUTOMATICALLY DILUTING AND RINSING

(75) Inventors: Xueping Jiang, Shenzhen (CN); Zhigang Zhong, Shenzhen (CN); Bo Liu, Shenzhen (CN); Chao Zeng, Shenzhen (CN)

(73) Assignee: Shenzhen Mindray Bio-Medical Electronics Co., Ltd., Shenzhen (CN)

( * ) Notice: Subject to any disclaimer, the term of this patent is extended or adjusted under 35 U.S.C. 154(b) by 1070 days.

(21) Appl. No.: 11/946,473

(22) Filed: Nov. 28, 2007

(65) Prior Publication Data

US 2008/0125910 A1 May 29, 2008

(30) Foreign Application Priority Data

Nov. 29, 2006 (CN) ..... 2006 1 0157192

(51) Int. Cl.
*B01F 15/02* (2006.01)

(52) U.S. Cl. ..... 366/138; 366/182.1; 366/182.4; 366/191

(58) Field of Classification Search ..... 366/182.1, 366/182.2, 182.3, 182.4, 101, 138
See application file for complete search history.

(56) References Cited

U.S. PATENT DOCUMENTS 4,580,699 A * 4/1986 Black et al. ..... 222/64
4,681,297 A * 7/1987 Mertz ..... 251/45
4,733,971 A * 3/1988 Pratt ..... 366/141
4,920,060 A 4/1990 Parrent, Jr. et al.
5,473,909 A * 12/1995 Kateman et al. ..... 62/306
5,507,305 A * 4/1996 Franklin ..... 134/57 R
5,628,561 A * 5/1997 Lambert, Sr. ..... 366/136
5,800,056 A * 9/1998 Suzuki et al. ..... 366/152.4
6,120,175 A * 9/2000 Tewell ..... 366/140
6,457,852 B1 * 10/2002 Hiraoka et al. ..... 366/136
6,554,467 B2 * 4/2003 Snyder et al. ..... 366/348
6,588,927 B2 * 7/2003 Hozan et al. ..... 366/152.3
6,874,929 B2 * 4/2005 Hiraoka ..... 366/152.6
7,063,455 B2 * 6/2006 Achkire et al. ..... 366/152.2
7,329,038 B2 * 2/2008 Hashiba ..... 366/101
7,364,349 B2 * 4/2008 Achkire et al. ..... 366/152.2
2002/0136087 A1 * 9/2002 Nakagawa et al. ..... 366/152.4
2002/0186613 A1 * 12/2002 Hiraoka et al. ..... 366/136
2003/0111488 A1 * 6/2003 Schell et al. ..... 222/64
2004/0130965 A1 * 7/2004 Achkire et al. ..... 366/152.2
2004/0240311 A1 * 12/2004 Hashiba ..... 366/101
2004/0244506 A1 12/2004 Harada
2005/0146982 A1 * 7/2005 Carlson et al. ..... 366/136
2007/0109912 A1 * 5/2007 Urquhart et al. ..... 366/136
2008/0125910 A1 * 5/2008 Jiang et al. ..... 700/265

FOREIGN PATENT DOCUMENTS

CN 2124757 12/1992
CN 2661337 12/2004
JP 9-297143 11/1997

* cited by examiner

*Primary Examiner* — Tony G Soohoo
(74) *Attorney, Agent, or Firm* — Kory D. Christensen; Stoel Rives LLP

(57) ABSTRACT

Disclosed is an auto-diluting and rinsing apparatus, comprising: a concentrated detergent container for holding concentrated detergent to be diluted; a diluter container for holding diluter, which is used to dilute the concentrated detergent; and a diluted detergent container for holding diluted detergent for rinsing, which are formed by mixing the concentrated detergent and the diluter; wherein the concentrated detergent container and the diluter container are communicated with a high pressure gas source, respectively, and the apparatus further comprising: a gas path controller, configured to control the diluted detergent container to be communicated with a low pressure gas source via a first gas path during a dilution process; and to be communicated with a high pressure gas source during a rinsing process.

22 Claims, 4 Drawing Sheets

APPARATUS AND METHOD FOR AUTOMATICALLY DILUTING AND RINSING

TECHNICAL FIELD

The present invention relates to an apparatus and method for diluting concentrated detergent and performing rinse operation with the same.

BACKGROUND ART

In a full-automatic biochemical analyzer, a reaction cuvette is rinsed by using detergent with certain concentration. However, such detergent is generally kept in a concentrated state when it is being transported and stored. Therefore, in order to obtain the detergent with appropriate concentration, the full-automatic biochemical analyzer also provides a function to automatically dilute the concentrated detergent before it is used to rinse the reaction cuvette. In this way, biohazards caused by manual operations may be avoided.

The dilution of detergent refers to uniformly mix the concentrated detergent with deionized water in a certain volume ratio. Conventional diluting methods include on-site dilution and liquid-storage dilution. In on-site dilution, the detergent is not diluted until the reaction cuvette is going to be rinsed. In this case, all the diluted detergent produced in a dilution process would be used up one time during the subsequent rinsing process of the reaction cuvette. In contrast, during the liquid-storage dilution, a certain amount of detergent is diluted and stored in advance, and then the diluted detergent would be used at any time thereafter for rinsing the reaction cuvettes.

Compared with the liquid-storage dilution, the drawbacks of the on-site dilution lie in that the biochemical analyzer operates too frequently, and in that the dilution ratio is difficult to be guaranteed since the amount of diluted liquid for each dilution process is very small and thereby the flow rate is difficult to control. However, the liquid-storage dilution can accurately control the flow-rate and decrease the frequency of biochemical analyzer's operation. Therefore, the liquid-storage dilution is widely applied.

In conventional liquid-storage dilution, it is typically by means of dosing pumps, injectors, high-pressure gas or gravities of their own, to drive the deionized water and the concentrated detergent into a liquid-storage container. But, the dosing pumps and injectors are costly, while driving with gravities of their own is not reliable and difficult to quantify. For this reason, the liquid-storage dilution driven by high-pressure gas is becoming popular.

According to the conventional method for liquid-storage dilution with use of high-pressure gas, the liquid-storage container is required to be kept in a low pressure (e.g., environmental pressure) during a dilution process, so that deionized water and concentrated detergent can be driven into a liquid-storage container by high-pressure gas. Then, during a rinsing process, the liquid-storage container is required to be kept in a high pressure, since the diluted detergent within the liquid-storage container should be driven into a reaction cuvette, which is kept in a low pressure. In order to avoid interference between the diluting and rinsing processes, the two processes are carried out separately, i.e., within two separate containers and having two separate sets of apparatus for control. This results in high cost and high complexity of a system for both diluting and rinsing.

Furthermore, according to the conventional method for liquid-storage dilution as above, the diluting process is not triggered until diluted detergent within the liquid-storage container is used up. Only when it is used up, a predetermined amount of deionized water and concentrated detergent are driven into the liquid-storage container. As a result, the diluting process would not be triggered if the diluted detergent within the liquid-storage container is consumed partly. Further, even if a diluting process is triggered, the dilution ratio cannot be guaranteed due to inability to determine the amount of deionized water and concentrated detergent that need to be driven into.

Therefore, there is a need for an apparatus and method for auto-diluting and rinsing, which can reduce costs and trigger the diluting process at any moment while keeping the dilution ratio.

SUMMARY OF THE INVENTION

An object of the present invention is to provide an apparatus for auto-diluting and rinsing, which is capable of carrying out a dilution process and a rinsing process within the same liquid-storage container.

Another object of the present invention is to provide an apparatus for auto-diluting and rinsing, which enables the diluting process to be triggered at any moment while keeping the dilution ratio.

In a first aspect, an auto-diluting and rinsing apparatus is provided, and comprises: a concentrated detergent container for holding concentrated detergent to be diluted; a diluter container for holding diluter, which is used to dilute the concentrated detergent; and a diluted detergent container for holding diluted detergent for rinsing, which are formed by mixing the concentrated detergent and the diluter; wherein the concentrated detergent container and the diluter container are communicated with a high pressure gas source, respectively, and the apparatus further comprising: a gas path controller, configured to control the diluted detergent container to be communicated with a low pressure gas source via a first gas path during a dilution process; and to be communicated with a high pressure gas source during a rinsing process.

In a second aspect, a method for auto-diluting and rinsing is also provided, which is carried out by an auto-diluting and rinsing apparatus, the apparatus including a concentrated detergent container for holding concentrated detergent to be diluted; a diluter container for holding diluter; and a diluted detergent container for holding diluted detergent; and the method comprising the following steps: causing the concentrated detergent container and the diluter container to be communicated with a high pressure gas source, respectively; causing the diluted detergent container to be communicated with a low pressure gas source; causing the concentrated detergent and the diluter, for a dilution process, to be alternately driven into the diluted detergent container via a first and second liquid path, respectively, by alternately opening the first and second liquid path, so as to obtain the diluted detergent; blocking the first and second liquid path after the dilution process; and causing the diluted detergent container, for a rinsing process, to be communicated with a high pressure gas source, so as to perform rinse operation with the produced diluted detergent.

In a third aspect, An auto-diluting apparatus is also provided, and comprising: a concentrated detergent container for holding concentrated detergent to be diluted; a diluter container for holding diluter, which is used to dilute the concentrated detergent; and a diluted detergent container for holding diluted detergents obtained by dilution; wherein the diluter container and the concentrated detergent container are communicated with a high pressure gas source, respectively, and are communicated with the diluted detergent container, which is communicated with a low-pressure gas source, via a first and second liquid path, respectively; and the apparatus further comprising: a liquid path controller, configured to control the first and second liquid path to be opened or blocked in such a way that the concentrated detergent and the diluter are alternately driven into the diluted detergent container for a plurality of times, during one dilution process, wherein, for each of the plurality of times, a ratio between opening duration of the first liquid path and that of the second liquid path corresponds to a desired dilution ratio.

In a fourth aspect, an auto-diluting method is also provided, which is carried out by a an auto-diluting apparatus, the apparatus includes a concentrated detergent container for holding concentrated detergent to be diluted; a diluter container for holding diluter used to dilute the concentrated detergent; and a diluted detergent container for holding diluted detergent after dilution; and the method comprising the following steps: causing the concentrated detergent container and the diluter container to be communicated with a high pressure gas source, respectively; causing the diluted detergent container to be communicated with a low pressure gas source; controlling a first and second liquid path to opened or blocked in such way that, during one dilution process, the concentrated detergent and the diluter are alternately driven into the diluted detergent container for a plurality of times, via the first and second liquid path, respectively, wherein, for each of the plurality of times, a ratio between opening duration of the first liquid path and that of the second liquid path corresponds to a desired dilution ratio.

BRIEF DESCRIPTION OF THE DRAWINGS

The above and other objects, features and advantages of the present invention are readily apparent from the following detailed description of the best mode for carrying out the invention when taken in connection with the accompanying drawings, in which.

BEST MODES FOR CARRYING OUT THE INVENTION

Aspects of the invention will be described in detail below with reference to the figures.

Figure 1:
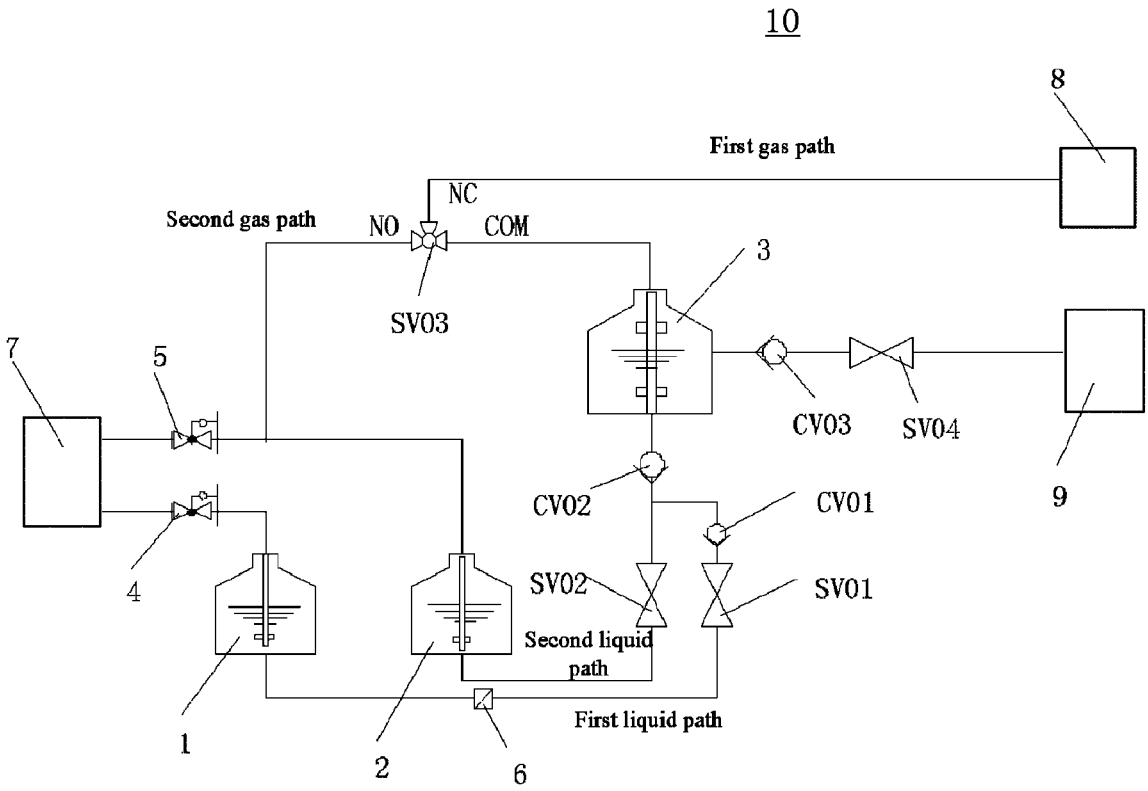
FIG. 1 is a schematic diagram showing the structure of an auto-diluting and rinsing apparatus 10 according to an embodiment of the present invention.

FIG. 1 is a schematic diagram showing the configuration of an auto-diluting and rinsing apparatus 10 according to an embodiment of the present invention.

As shown in FIG. 1, the auto-diluting and rinsing apparatus 10 comprises: a concentrated detergent container 1 for holding concentrated detergent; a deionized water container 2 for holding deionized water; and a diluted detergent container 3 for holding diluted detergent. Here, the concentrated detergent container 1 and the deionized water container 2 are communicated with the diluted detergent container 3 via a first and second liquid path, respectively, so that the concentrated detergents and the deionized water can be driven into the diluted detergent container 3, respectively.

In FIG. 1, the concentrated detergent container 1 is communicated with a high-pressure gas source 7 via a pressure-regulating valve 4, and the deionized water container 2 is also communicated with the high-pressure gas source 7 via a pressure-regulating valve 5. As a result, the pressures of the two containers 1 and 2 are kept in a high pressure. Alternatively, the containers 1 and 2 can also be communicated with two separate high-pressure gas sources, respectively, as desired.

As shown in FIG. 1, the diluted detergent container 3 is connected to a common (COM) terminal of a three-way solenoid valve SV03. The normally open (NO) terminal of the valve SV03 is communicated with the high-pressure gas source 7 via a pressure regulating valve 5, and the normally closed (NC) terminal of the valve SV03 is communicated with a low-pressure gas source 8 (e.g., atmospheric environment).

Figure 4:
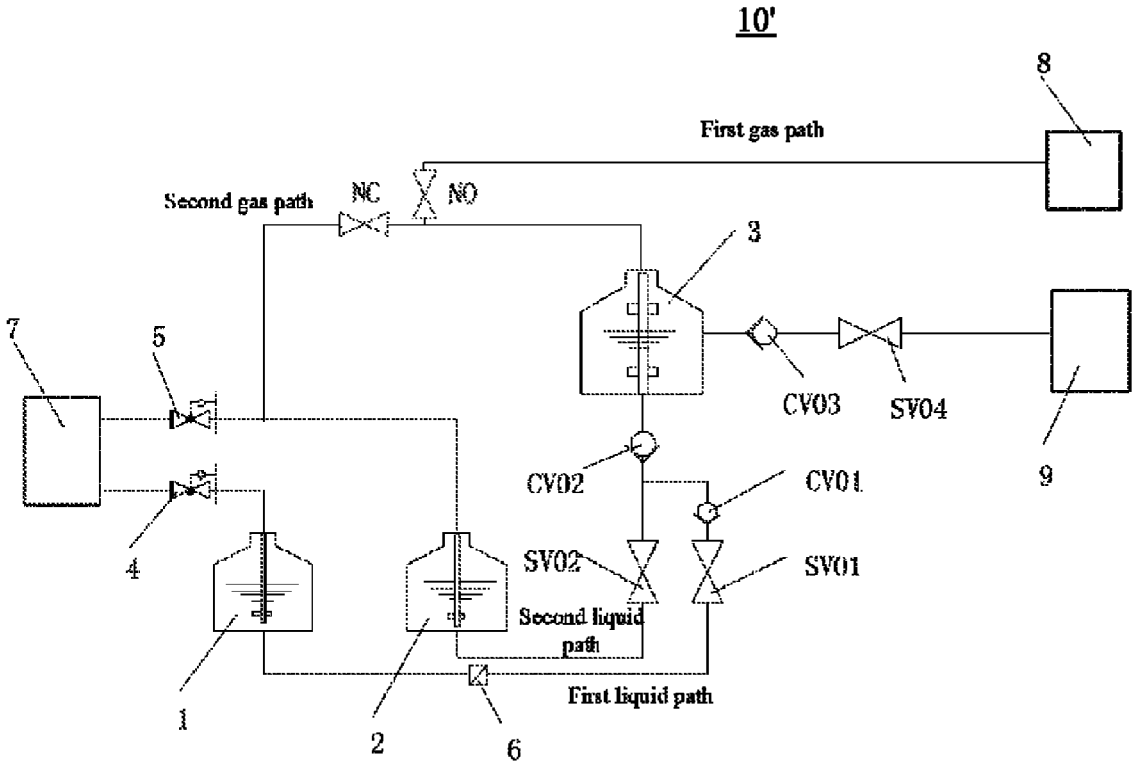
FIG. 4 is a schematic diagram showing the structure of an auto-diluting and rinsing apparatus 10' according to an alternative embodiment.

With the configuration as shown in FIG. 1, when the valve SV03 is turned on, that is, the COM terminal of the valve SV03 is communicated with the NC terminal thereof (i.e., the first gas path is open), the diluted detergent container 3 is communicated with the low-pressure gas source 8 for dilution. In contrast, when the valve SV03 is turned off, that is, the COM terminal of the valve SV03 is communicated with the NO terminal thereof (i.e., the second gas path is open), the diluted detergent container 3 is communicated with the high-pressure gas source 7 for rinsing. Thus, by means of the three-way solenoid valve SV03, the diluted detergent container 3 can be switched to be in a high pressure or a low pressure, as desired. Alternatively, as depicted in the alternative apparatus 10' in FIG. 4, the three-way solenoid valve SV03 in the embodiment depicted in FIG. 1 can be replaced with at least two two-way solenoid valves, where one is a normally open type of valve NO, and the other is a normally closed type of valve NC, with the normally open type valve NO provided on the first gas path and the normally closed type valve NC provided on the second gas path.

Referring to FIG. 1, the concentrated detergent container 1 is communicated with the diluted detergent container 3 via a two-way solenoid valve SV01, which is a normally close type of valve; and the deionized water container 2 is communicated with the diluted detergent container 3 via a solenoid valve SV02, which is a normally close type of valve. When the diluted detergent container 3 is in a low pressure, the valve SV01 and SV02 may be turned on or off in sequence, so that the concentrated detergent and the deionized water can be alternately driven into the diluted detergent container 3 under a high-pressure gas. Here, the duration in which the valve SV01/SV02 is turned on corresponds to the amount of the concentrated detergent/the deionized water that has been driven into the container 3. Thus, the volume ratio between the concentrated detergent and the deionized water (i.e., dilution ratio) can be controlled and adjusted, by controlling and adjusting the turn-on duration for each of the valves SV01 and SV02.

Further, the apparatus 10 may further include an upper-liquid-level sensor (not shown), which is provided within the diluted detergent container 3. The upper-liquid-level sensor is used to detect whether the liquid level of the diluted detergent within the container 3 reaches a predetermined position, for preventing the overflow of the detergent. The valve SV01 and SV02 can be turned on alternately until the upper-level sensor detects that the predetermined position is reached. That is, the diluting process will keep on until desired amount of diluted detergent is obtained in container 3, without judging the amount of the concentrated detergent and the deionized water driven into the container 3.

Preferably, a filter 6 is further provided on the first liquid path between the concentrated detergent container 1 and the diluted detergent container 3, for filtering any crystal that may be contained in the concentrated detergent.

In addition, in order to carry out the rinsing process, the diluted detergent container 3 is further communicated with a reaction cuvette 9 via a solenoid valve SV04. Normally, the reaction cuvette 9 is kept in a low pressure, such as atmospheric pressure. When the diluted detergent container 3 is in a high pressure, the valve SV04 is turned on, and thus the reaction cuvette can be rinsed.

Preferably, the apparatus 10 may further include check valves CV01 and CV02. The check valve CV01 is arranged between the diluted detergent container 3 and the concentrated detergent container 1; and the check valve CV02 is arranged between the diluted detergent container 3 and the deionized water container 2. During the rinsing process, these check valves are used to prevent the diluted detergent from backflow, i.e., from being driven back to the deionized water container 2 and the concentrated detergent container 1. A check valve CV03 may also be arranged between the diluted detergent container 3 and the reaction cuvette 9, so as to prevent the liquid in reaction cuvette 9 from backflow to the diluted detergent container 3.

It should be noted that, in this embodiment, the pressure of the high-pressure gas source is relatively high with respect to that of the low pressure gas source. And the pressure values for each of the gas sources may be determined based on practical requirements. But it is required to have a pressure difference between the two gas sources, so that the liquid in the concentrated detergent container 1 and the deionized water container 2 can be driven into the diluted detergent container 3 under the high pressure gas. In present embodiment, the low-pressure gas source may be the atmospheric environment.

Next, the operation process of the auto-diluting and rinsing apparatus 10 according to the present invention will be described in detail below in connection with FIG. 2.

Figure 2:
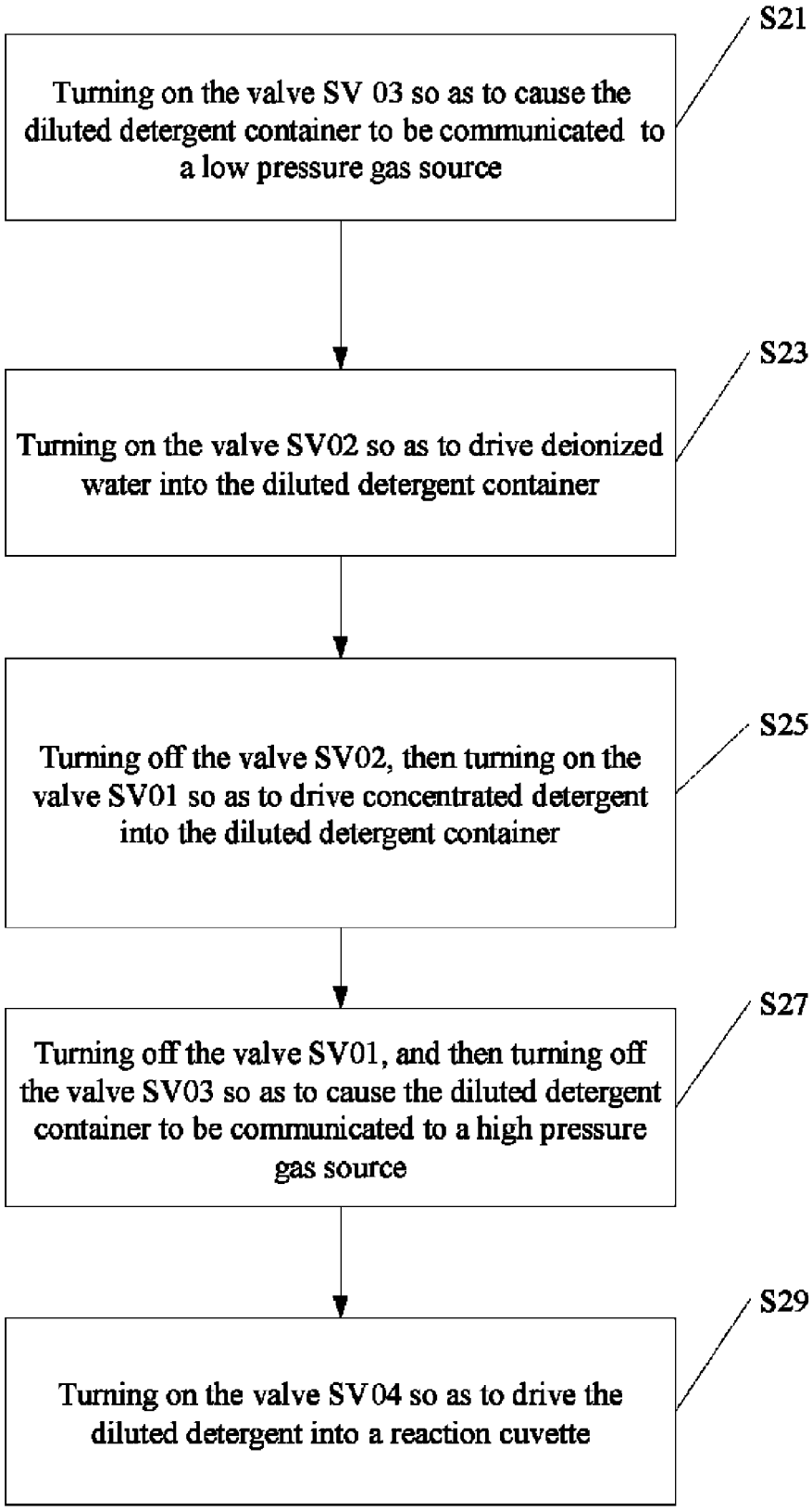
FIG. 2 shows an example of diluting and rinsing processes by the auto-diluting and rinsing apparatus according to an embodiment of the present invention.

FIG. 2 shows an example of diluting and rinsing processes performed by the auto-diluting and rinsing apparatus according to the present invention.

As shown in FIG. 2, before the diluting process begins, the solenoid valve SV03 is normally closed, i.e., its COM terminal is communicated with its NO terminal. At this time, the diluted detergent container 3 communicates with the high-pressure gas source 7 and thus it is kept in a high pressure.

Then, upon the dilution process is triggered, the solenoid valve SV03 is turned on, that is, communicating the COM terminal with the NC terminal thereof, and thus the diluted detergent container 3 is communicated with the low pressure source 8 (atmosphere). As a result, the pressure in the diluted detergent container 3 is released gradually (step S21).

When the pressure in the diluted detergent container 3 is released to the environmental pressure, the solenoid valve SV02 is turned on and thus the second liquid path between the deionized water container 2 and the diluted detergent container 3 is open. At this time, since the pressure in the deionized water container 2 is higher than that in the diluted detergent container 3, a certain amount of deionized water can be driven into the diluted detergent container 3 under the pressure difference between the containers 2 and 3 (step S23).

Upon the certain amount of deionized water is completely driven into container 3, the solenoid valve SV02 is turned off to block the second liquid path, and then the solenoid valve SV01 is turned on to open the first liquid path between the concentrated detergent container 1 and the diluted detergent container 3. At this time, since the pressure in the container 1 is higher than that in the container 3, a certain amount of concentrated detergent can be driven into the diluted detergent container 3 under the pressure difference between containers 1 and 3 (step S25). Then, in the diluted detergent container 3, the driven concentrated detergent is mixed with deionized water driven previously to dilute the concentrated detergent. After the certain amount of the concentrated detergent is completely driven into container 3, the solenoid valve SV01 is turned off to block the first liquid path.

It would be apparent for those skilled in the art that the order of opening the first and second liquid path, i.e., the order of driving the concentrated detergent and deionized water into the container 3, may be exchanged, and the same effect can also be achieved.

After the completion of the dilution process, i.e., after both of the valves SV01 and SV02 are turned off, the pressure in the diluted detergent container 3 keeps at an atmospheric pressure. At this time, the valve SV03 is turned off, that is, the COM terminal is communicated with its NO terminal, and thereby the diluted detergent container 3 is communicated with the high pressure gas source 7, so that the pressure in the diluted detergent container 3 increases (step S27).

Upon the pressure in the diluted detergent container 3 reaches a certain high value, the valve SV04 is turned on. Thus, a certain amount of diluted detergent is driven under a high-pressure gas into the reaction cuvette 9 for rinsing (step S29). After the desired amount of the diluted detergent is completely driven into the reaction cuvette 9, the valve SV04 is turned off.

It should be noted here that, the auto-diluting and rinsing apparatus may be configured to operate in such a way that the rinsing process is carried out immediately after the dilution process. In an alternative embodiment, the diluted detergent, obtained in the dilution process, may be hold in the container 3 for future usage of rinsing.

During the dilution and rinsing processes as shown in FIG. 2, the valves SV01, SV02, SV03 and SV04 on respective liquid paths and gas paths are turned on or off, under the control of a predetermined control timing. Here, the ratio between the turn on duration of the valve SV01 and that of SV02 (i.e., opening duration of the respective liquid path) is preset based on a desired dilution ratio.

With the dilution and rinsing processes as shown in FIG. 2, it is unnecessary, during the diluting process, to drive total amount of the concentrated detergent or deionized water into the diluted detergent container 3 for one time. In an alternative embodiment, it is still possible to alternately drive the concentrated detergent and deionized water into the container 3 for many times, so as to reach the total amount. Specifically, for each time, a small amount of concentrated detergent and deionized water are driven into container 3 in sequence, but with an amount ratio between the added concentrated detergent and the added deionized water matching the desired dilution ratio. Then, the above driving steps may be repeated for many times until the total amount reaches.

The following is an example of the above-mentioned multiple alternate driving method, in which the deionized water and the concentrated detergent are alternately driven into container 3 for many times.

By ways of an example, assumed that the dilution ratio is 1:2, i.e., the volume ratio of the concentrated detergent and deionized water is 1:2. Thus, in each time of alternate driving, it is required to alternately drive, for example, the concentrated detergent of 1 ml and the deionized water of 2 ml into the container 3. This, for example, corresponds to such a case that the solenoid valve SV02 is first turned on for 0.2 s and then turned off, and subsequently the solenoid valve SV01 is turned on for 0.1 s and then turned off. Here, assumed that the cross-sections of the valves SV01 and SV02 have the same area and the flow rates of the liquid thereof are same too. In this manner, valves SV01 and SV02 may be turned on and off periodically, and thereby alternately driving the concentrated detergent and deionized water into container 3 for many times. Such a multiple alternate driving method may continue until the upper-liquid-level sensor provided within the container 3 detects that the liquid level of the diluted detergent has reached the predetermined position.

Figure 3A:
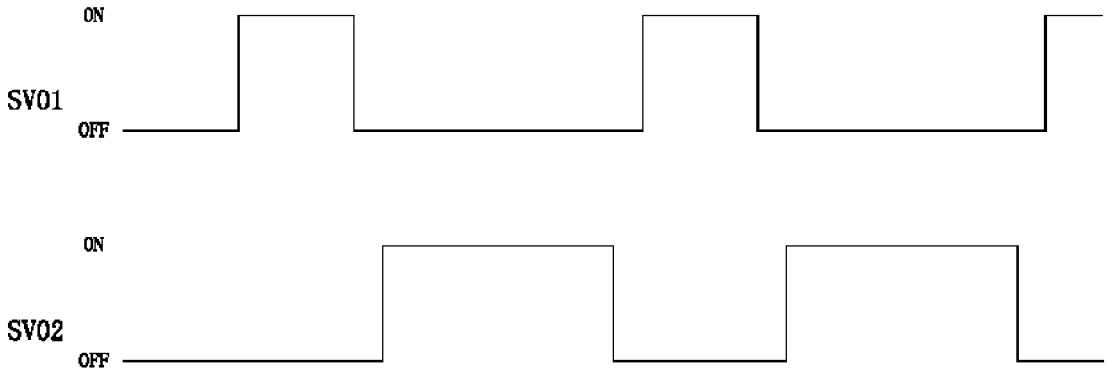
FIGS. 3A and 3B show the control timing of the solenoid valves SV01 and SV02.
Figure 3B:
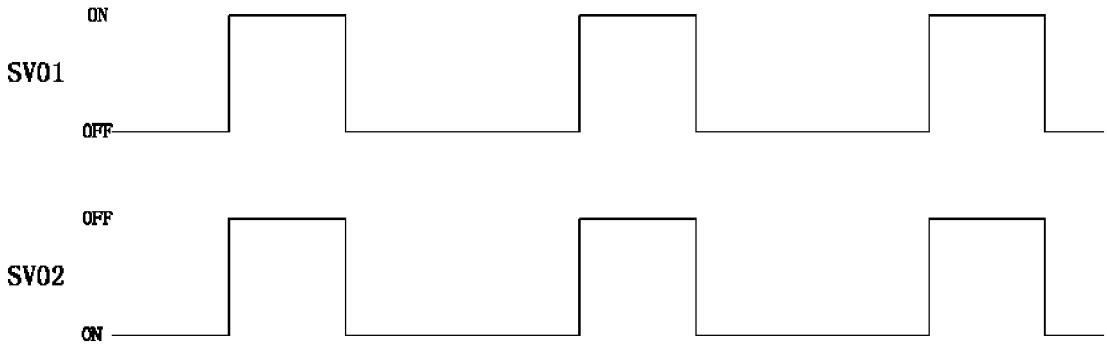

Here, the valves SV01 and SV02 are turned on and off under control signals having two different control timings, which are cooperated with each other, as shown in FIG. 3A. In FIG. 3A, both of valves SV01 and SV02 are turned on when the control signal is set to a high level, and only one of the two valves is turned on at the same time. Further, based on the dilution ratio of the above example, the turn on duration (opening duration of the liquid path) for the valve SV02 is two times of that for the valve SV01 during each cycle. Alternatively, the valves SV01 and SV02 can be controlled only by a single timing, as shown in FIG. 3B. In FIG. 3B, the valve SV01 is turned on when the control signal is set to a high level; and the valve SV02 is turned on when the control signal is set to a low level. In other words, the valve SV01 is turned on while the valve SV 02 is turned off, and vice versa. Also, in FIG. 3B, the turn on duration for valves SV01 and SV02 is set based on the dilution ratio, that is, the turn on duration for valves SV02 is two times of that for valve SV01 during each cycle.

With the multiple alternate driving method as mentioned above, the concentrated detergent and deionized water may be driven into container 3 in very small amount for each time, while the dilution ratio can be guaranteed. In special, in case that the desired amount of dilution is unknown, with this method, a small amount of diluted detergent can be acquired repeatedly, and such a dilution process may continue until the liquid level in the diluted detergent container 3 reaches an upper-liquid-level float (i.e. an upper-liquid-level sensor). In this way, the dilution process can be triggered at any moment while keeping the dilution ratio.

The multiple alternate driving method as described above may also be applied to the conventional diluting apparatus to trigger the dilution process at any moment.

In addition, although the invention is described by taking deionized water as an example, it should be understood that other kinds of diluters can be also used herein, such as pure water etc.

Beneficial Effects

With the apparatus and method for auto-diluting and rinsing according to the present invention, diluting and rinsing processes can be carried out within the same diluted detergent container, which reduces the costs and complexity of the system, and ensures that the diluting process and the rinsing process do not interfere with each other.

Further, with the apparatus and method for auto-diluting and rinsing, according to the present invention, the controllers (such as SV01~04) arranged in respective liquid paths and gas paths may be controlled and adjusted based on a preset control timing, which controls the turned on duration for each of the first and second liquid paths according to the desired dilution ratio, so that the amount of concentrated detergent and deionized water that have been driven into the container 3 can be well controlled, and thus the desired dilution ratio can be achieved easily. Therefore, diluting process may be triggered at any moment while keeping a constant dilution ratio.

It should be understood by those skilled in the art that various modifications may be made to the auto-diluting and rinsing apparatus and method as disclosed by the present invention, without departing from the scope of the present invention. Therefore the protection scope of the present invention should be defined by the appended claims.

What is claimed is:

1. An apparatus for auto-diluting and rinsing, the apparatus comprising:

a concentrated detergent container for holding concentrated detergent to be diluted;

a diluter container for holding diluter;

a diluted detergent container for holding diluted detergent that is formed by mixing the concentrated detergent and the diluter;

a high pressure gas source in communication with at least one of the concentrated detergent container and the diluter container so as to urge one or more of the concentrated detergent and the diluter into the diluted detergent container;

a low pressure gas source, wherein the low pressure gas source is at a lower pressure than the high pressure gas source;

a first gas path in communication with the low pressure gas source;

a second gas path in communication with the high pressure gas source; and a gas path controller configured to permit the diluted detergent container to alternatively communicate with either the low pressure gas source via the first gas path or the high pressure gas source via the second gas path.

2. The apparatus of claim 1, wherein the gas path controller includes a normally open type of two-way solenoid valve and a normally closed type of two-way solenoid valve, which are provided on the first and second gas path, respectively.

3. The apparatus of claim 1, wherein the gas path controller includes a three-way solenoid valve, wherein a COM terminal of the three-way solenoid valve is connected with the diluted detergent container, and wherein two other terminals of the three-way solenoid valve are connected with the low-pressure gas source and the high-pressure gas source via the first and second gas paths, respectively.

4. The apparatus of claim 1, wherein the concentrated detergent and the diluter are driven into the diluted detergent container via a first and a second liquid path, respectively, and the apparatus further includes:

a liquid path controller configured to control the first and second liquid path to be opened or blocked in such a way that the concentrated detergent and the diluter are alternately driven into the diluted detergent container for a plurality of times during a dilution process, wherein, for each of the plurality of times, a ratio between opening duration of the first liquid path and that of the second liquid path corresponds to a desired dilution ratio.

5. The apparatus of claim 4, further comprising an upper-liquid-level sensor configured to detect whether the liquid level of the diluted detergent within the diluted detergent container reaches a predetermined position, wherein the liquid path controller is configured to continue operating until the upper-liquid-level sensor detects that the predetermined position is reached.

6. The apparatus of claim 4, further comprising a filter provided on the first liquid path for filtering the liquid flowing through the first liquid path.

7. The apparatus of claim 4, further comprising one or more check valves provided on at least one of the first and second liquid paths, respectively, for preventing the liquid within the diluted detergent container from backflow.

8. The apparatus of claim 1, wherein a single high pressure gas source is in communication with each of the concentrated detergent container and the diluter container.

9. The apparatus of claim 8, wherein a first pressure-regulating valve is positioned between the high pressure gas source and the concentrated detergent container and a second pressure-regulating valve is positioned between the high pressure gas source and the diluter container.

10. The apparatus of claim 1, wherein the concentrated detergent container is configured to selectively communicate with the diluted detergent container via a first liquid path and the diluter container is configured to selectively communicate with the diluted detergent container via a second liquid path.

11. The apparatus of claim 10, wherein the first liquid path includes a valve configured to selectively permit concentrated detergent to move from the concentrated detergent container to the diluted detergent container, and wherein the second liquid path includes a valve configured to selectively permit diluter to move from the diluter container to the diluted detergent container.

12. The apparatus of claim 1, wherein when the diluted detergent container communicates with the low pressure gas source, the concentrated detergent and diluter are each at a pressure that is higher than the pressure of the low pressure gas source, and at least one of the concentrated detergent and diluter enter the diluted detergent container for mixing, and wherein after the diluted detergent container has communicated with the high pressure gas source, such that a pressure within the diluted detergent container is higher than the pressure of the low pressure gas source, the diluted detergent is permitted to exit the diluted detergent container.

13. The apparatus of claim 1, further comprising a valve that is configured to selectively permit diluted detergent to be expelled from the diluted detergent container, wherein the valve is configured to be in a closed state when the diluted detergent container communicates with the low pressure gas source so as to maintain diluted detergent within the diluted detergent container as concentrated detergent and diluter enter the diluted detergent container for mixing, and wherein the valve is configured to be in an open state after the diluted detergent container has communicated with the high pressure gas source, such that a pressure within the diluted detergent container is higher than the pressure of the low pressure gas source, so as to permit diluted detergent to exit the diluted detergent container.

14. An apparatus for auto-diluting and rinsing, the apparatus comprising:

a concentrated detergent container for holding concentrated detergent to be diluted;

a diluter container for holding diluter, which is used to dilute the concentrated detergent;

a diluted detergent container for holding diluted detergent for rinsing, which is formed by mixing the concentrated detergent and the diluter;

a high pressure gas source in communication with at least one of the concentrated detergent container and the diluter container so as to urge one or more of the concentrated detergent and the diluter into the diluted detergent container;

a low pressure gas source, wherein the low pressure gas source is at a lower pressure than the high pressure gas source;

a first gas path in communication with the low pressure gas source;

a second gas path in communication with the high pressure gas source; and a gas path controller configured to control the diluted detergent container to be communicated with the low pressure gas source via the first gas path when the apparatus is in a dilution operational mode; and to be communicated with the high pressure gas source when the apparatus is in a rinsing operational mode, wherein the concentrated detergent and the diluter are driven into the diluted detergent container via a first and a second liquid path, respectively, and wherein the apparatus further includes:

a liquid path controller configured to control the first and second liquid path to be opened or blocked in such a way that the concentrated detergent and the diluter are alternately driven into the diluted detergent container for a plurality of times during a dilution process, wherein, for each of the plurality of times, a ratio between opening duration of the first liquid path and that of the second liquid path corresponds to a desired dilution ratio.

15. The apparatus of claim 14, further comprising an upper-liquid-level sensor configured to detect whether the liquid level of the diluted detergent within the diluted detergent container reaches a predetermined position, wherein the liquid path controller continues to be operated until the upper-liquid-level sensor detects that the predetermined position is reached.

16. The apparatus of claim 14, further comprising a filter provided on the first liquid path for filtering the liquid flowing through the first liquid path.

17. The apparatus of claim 14, further comprising check valves provided on at least one of the first and second liquid paths, respectively, for preventing the liquid within the diluted detergent container from backflow.

18. An apparatus for auto-diluting and rinsing, the apparatus comprising:

a concentrated detergent container for holding concentrated detergent to be diluted;

a diluter container for holding diluter;

a diluted detergent container for holding diluted detergent;

a first liquid path between the concentrated detergent container and the diluted detergent container, wherein the first liquid path is configured to selectively permit concentrated detergent to pass from the concentrated detergent container to the diluted detergent container;

a second liquid path between the diluter container and the diluted detergent container, wherein the second liquid path is configured to selectively permit diluter to pass from the diluter container to the diluted detergent container;

a high pressure gas source in communication with at least one of the concentrated detergent container and the diluter container so as to urge one or more of the concentrated detergent and the diluter through one or more of the first and second liquid paths, respectively, into the diluted detergent container;

a low pressure gas source, wherein the low pressure gas source is at a lower pressure than the high pressure gas source;

a first gas path in communication with the low pressure gas source;

a second gas path in communication with the high pressure gas source; and a gas path controller configured to permit the diluted detergent container to alternatively communicate with either the low pressure gas source via the first gas path when the apparatus is in a dilution operational mode, or the high pressure gas source via the second gas path when the apparatus is in a rinsing operational mode.

19. The apparatus of claim 18, wherein the first liquid path comprises a first valve configured to selectively permit passage of concentrated detergent to the diluted detergent container, and wherein the second liquid path comprises a second valve configured to selectively permit passage of diluter to the diluted detergent container.

20. The apparatus of claim 19, wherein the first and second valves are configured to alternatingly open and close such that concentrated detergent and diluter are alternatingly introduced into the diluted detergent container at different times.

21. The apparatus of claim 18, wherein when the apparatus is in the dilution operational mode:

the diluted detergent container communicates with the low pressure gas source so as to be at the pressure thereof;

one or more of the concentrated detergent and diluter are at a pressure that is higher than the pressure of the low pressure gas source; and one or more of the concentrated detergent and diluter are permitted to enter the diluted detergent container for mixing, and when the apparatus is in the rinsing operational mode:

the diluted detergent container has communicated with the high pressure gas source such that a pressure within the diluted detergent container is higher than the pressure of the low pressure gas source; and the diluted detergent is permitted to exit the diluted detergent container.

22. The apparatus of claim 18, further comprising a valve that is configured to selectively permit diluted detergent to be expelled from the diluted detergent container, wherein the valve is configured to be in a closed state when the apparatus is in the dilution operational mode in which concentrated detergent and diluter are mixed within the diluted detergent container, and wherein the valve is configured to be in an open state when the apparatus is in the rinsing operational mode in which diluted detergent is expelled from the diluted detergent container.

* * * * *